United States Patent [19]

Milton

[11] Patent Number: 4,673,280

[45] Date of Patent: Jun. 16, 1987

[54] TRANSFER CHARGE CONTROL SYSTEM

[75] Inventor: Derek J. Milton, Welwyn Garden City, England

[73] Assignee: Xerox Corporation, Stamford, Conn.

[21] Appl. No.: 783,998

[22] Filed: Oct. 4, 1985

[30] Foreign Application Priority Data

Oct. 15, 1984 [GB] United Kingdom ..... 8426044

[51] Int. Cl.[4] ..... G03G 15/16

[52] U.S. Cl. ..... 355/3 CH; 250/325; 355/14 TR

[58] Field of Search ..... 355/3 R, 3 CH, 3 TR, 355/14 TR; 250/324, 325, 326

[56] References Cited

U.S. PATENT DOCUMENTS 3,620,617 11/1971 Kelly ..... 355/3
3,850,519 11/1974 Weikel, Jr. ..... 355/3 R
4,055,380 10/1977 Borostyan ..... 355/3 R
4,077,709 3/1978 Borostyan et al. ..... 355/3 TR
4,408,863 10/1983 Ogata et al. ..... 355/3 TR
4,478,870 10/1984 Haneda et al. ..... 355/3 TR X
4,491,407 1/1985 Mitsuyama et al. ..... 355/3 TR

FOREIGN PATENT DOCUMENTS 2127348A 3/1978 United Kingdom .

*Primary Examiner*—Fred L. Braun
*Attorney, Agent, or Firm*—Mark Costello

[57] ABSTRACT

The transfer station of an electrostatographic apparatus includes a transfer corotron which assists the transfer of a developed image to a copy sheet. The shield of the transfer corotron is allowed to self-bias to a potential controlled by a Zener diode, and this potential is applied to a sheet guide member. Copy paper sheets are fed over a sheet guiding portion of the guide member towards the photoconductor drum, and while the sheets are in contact with the guide member they acquire the potential which is predetermined to ensure optimum transfer conditions.

4 Claims, 9 Drawing Figures

TRANSFER CHARGE CONTROL SYSTEM

BACKGROUND OF THE INVENTION

This invention relates to an image transfer system in electrostatography in which copy sheet transfer charge leakage is automatically compensated for by the transfer system.

In many electrostatographic apparatuses, a developed electrostatic latent image is transferred from an imaging surface onto a copy sheet by a transfer arrangement which comprises a transfer corotron operated at a polarity and potential such as to assist the transfer of the developed image.

A problem with transfer systems of this kind is that in order to achieve a good transfer, the paper copy sheet has to be of relatively low conductivity. If the conductivity of the paper is too high, charges on the paper immediately leak away via those parts of the machine which are in contact with the sheet, such as paper guides. Many papers suitable for xerographic copy paper have a conductivity which is satisfactory when the paper is dry, but which becomes too high for good transfer efficiency when the paper is damp. Thus, under conditions of high ambient relative humidity, many copy papers become too conductive to work properly, and in extreme cases receive virtually no transferred image at all during the transfer step of the copy cycle.

One form of transfer charge control system is described in UK Patent Specification No. 2 127 348A, in which a predetermined potential approximating the surface potential of a copy sheet during transfer is applied to a conductive guide member. The guide member acts both as a spatial limiter for the corona discharge produced by the transfer corotron and as a guide for directing copy sheets into contact with the imaging surface. The predetermined potential is supplied by a tapping of the high voltage supply for the corotrons in the apparatus, or by a separate supply.

U.S. Pat. No. 4 077 709 describes a transfer charge control system in which conductive sheet guards are electrically isolated and biassed to the same potential as the shield of the transfer corotron by means of an applied potential which is substantially ground potential.

An alternative transfer charge control system is described in U.S. Pat. No. 4 055 380, in which conductive guide members are connected to ground only through a high resistance, which provides a self-biasing floating potential on the guide members. The potential on the guide members and the potential on the shield of the transfer corotron are not directly related to one another.

SUMMARY OF THE INVENTION

It is an object of the present invention to provide an improved solution to this problem, and to provide a transfer charge control system which is very inexpensive, requiring neither a separate source within the machine, nor a connection to the existing high voltage power supply of the machine.

It is a further object of the invention to use a self biasing potential of the transfer corotron shield to provide a well-controlled, predetermined potential on the copy sheet guide member.

According to the present invention, there is provided electrostatographic apparatus including transfer means for transferring a developed electrostatic latent image from an imaging surface onto a copy sheet, the transfer means comprising a transfer corotron arranged to be operated at a polarity and potential such as to assist the transfer of a developed image to the copy sheet, and a conductive guide member extending into or adjacent the region between the transfer corotron and the imaging surface to act as a spatial limiter for the corona discharge produced by the transfer corotron and to act as a guide for guiding copy sheets into contact with the imaging surface, the guide member having associated therewith means to maintain thereon a predetermined potential approximating the surface potential of a copy sheet during transfer, and the guide member being in electrical communication with the shield of the transfer corotron, that said shield being self-biasing to a potential such as to maintain said predetermined potential on said guide member.

The foregoing and other objects, features and advantages of the invention will be apparent from the following more particular description of the preferred embodiments of the invention, as illustrated in the accompanying drawings.

DESCRIPTION OF THE PREFERRED EMBODIMENTS

Figure 1:
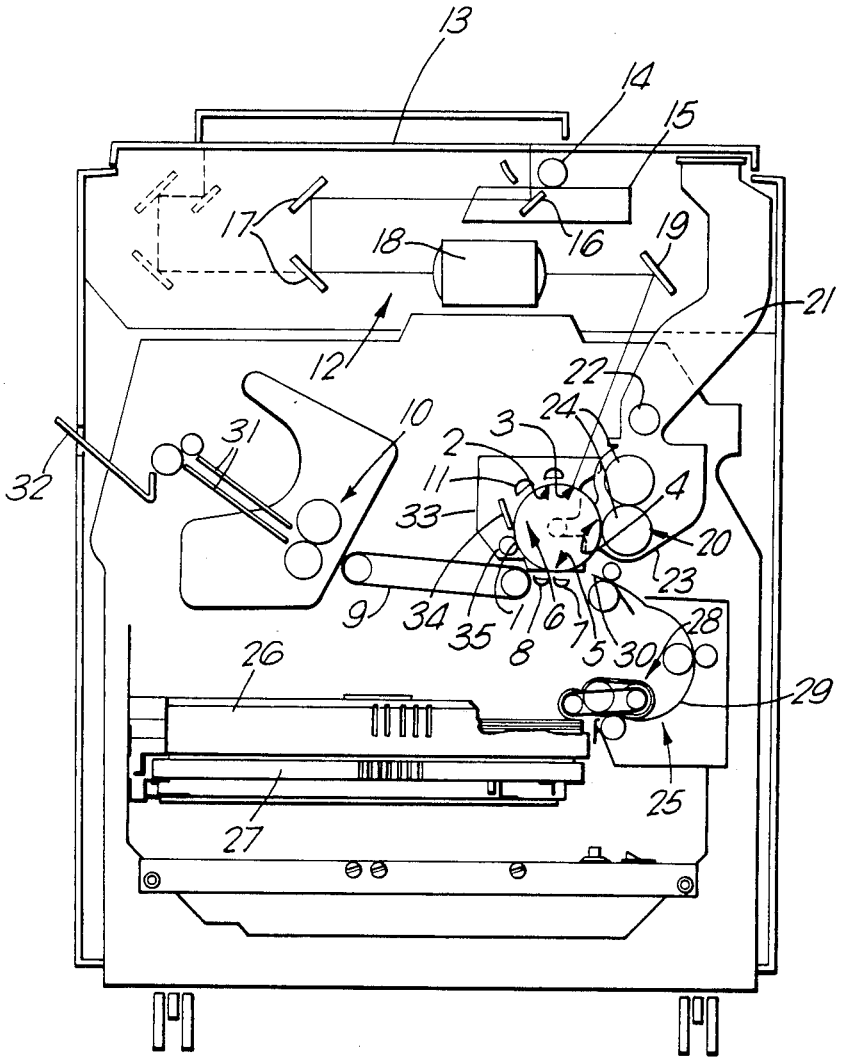
FIG. 1 is a diagrammatic cross-sectional view of a xerographic copying machine incorporating the invention.

Referring first to FIG. 1 there is shown a xerographic copying machine incorporating the present invention. The machine includes a photoreceptor drum 1 mounted for rotation (in the clockwise direction as seen in FIG. 1) to carry the photoconductive imaging surface of the drum sequentially through a series of xerographic processing stations: a charging station 2, an imaging station 3, a development station 4, a transfer station 5, and a cleaning station 6.

The charging station 2 comprises a corotron which deposits a uniform electrostatic charge on the photoreceptor. A document to be reproduced is positioned on a platen 13 and scanned by means of a moving optical scanning system to produce a flowing light image on the drum at 3. The optical image selectively discharges the photoconductor in image configuration, whereby an electrostatic latent image of the object is laid down on the drum surface. At the development station 4, the electrostatic latent image is developed into visible form by bringing into contact with it toner particles which deposit on the charged areas of the photoreceptor. Cut sheets of paper are moved into the transfer station 5 in synchronous relatin with the image on the drum surface and the developed image is transferred to a copy sheet at the transfer station 5, where a transfer corotron 7 provides an electric field to assist in the transfer of the toner particles thereto. The copy sheet is then stripped from the drum 1, the detachment being assisted by the electric field provided by a de-tack corotron 8. The copy sheet carrying the developed image is then carried by a transport belt system 9 to a fusing station 10.

After transfer of the developed image from the drum, some toner particles usually remain on the drum, and these are removed at the cleaning station 6. After cleaning, any electrostatic charges remaining on the drum are removed by an erase corotron 11. The photoreceptor is then ready to be charged again by the charging corotron 2, as the first step in the next copy cycle.

The optical image at imaging station 3 is formed by optical system 12. A document (not shown) to be copied is placed on platen 13, and is illuminated by a lamp 14 that is mounted on a scanning carriage 15 which also carries a mirror 16. Mirror 16 is the full-rate scanning mirror of a full and half-rate scanning system. The full-rate mirror 16 reflects an image of a strip of the document to be copied onto the half-rate scanning mirror 17. The image is focussed by a lens 18 onto the drum 1, being deflected by a fixed mirror 19. In operation, the full-rate mirror 16 and lamp 14 are moved across the machine at a constant speed, while at the same time the half-rate mirrors 17 are moved in the same direction at half that speed. At the end of a scan, the mirrors are in the position shown in a broken outline at the left hand side of FIG. 1. These movements of the mirrors maintain a constant optical path length, so as to maintain the image on the drum in sharp focus throughout the scan.

At the development station 4, a magnetic brush developer system 20 develops the electrostatic latent image. Toner is dispensed from a hopper 21 by means of a rotating foam roll dispenser 22, into developer housing 23. Housing 23 contains a 2-component developer mixture comprising a magnetically attractable carrier and the toner, which is brought into developing engagement with drum 1 by a two-roller magnetic brush developing arrangement.

The developed image is transferred, at transfer station 5, from the drum to a sheet of copy paper (not shown) which is delivered into contact with the drum by means of a paper supply system 25. Paper copy sheets are stored in two paper trays, an upper, main tray 26 and a lower, auxiliary tray 27. The top sheet of paper in either one of the trays is brought, as required, into feeding engagement with a common, fixed position, sheet feeder 28. Sheet feeder 28 feeds sheets around curved guide 29 for registration at a registration point 30. Once registered, the sheet is fed into contact with the drum in synchronous relation to the image so as to receive the image at transfer station 5.

The copy sheet carrying the transferred image is transported, by means of vacuum transport belt 9, to fuser 10, which is a heated roll fuser. The image is fixed to the copy sheet by the heat and pressure in the nip between the two rolls of the fuser. The final copy is fed by the fuser rollers along output guides 31 into catch tray 32, which is suitably an offsetting catch tray.

After transfer of the developed image from the drum to the copy sheet, the drum surface is cleaned at cleaning station 6. At the cleaning station, a housing 33 forms with the drum 1 an enclosed cavity, within which is mounted a doctor blade 34. Doctor blade 34 scrapes residual toner particles off the drum, and the scraped off particles then fall into the bottom of the housing, from where they are removed by an auger 35.

Figure 2:
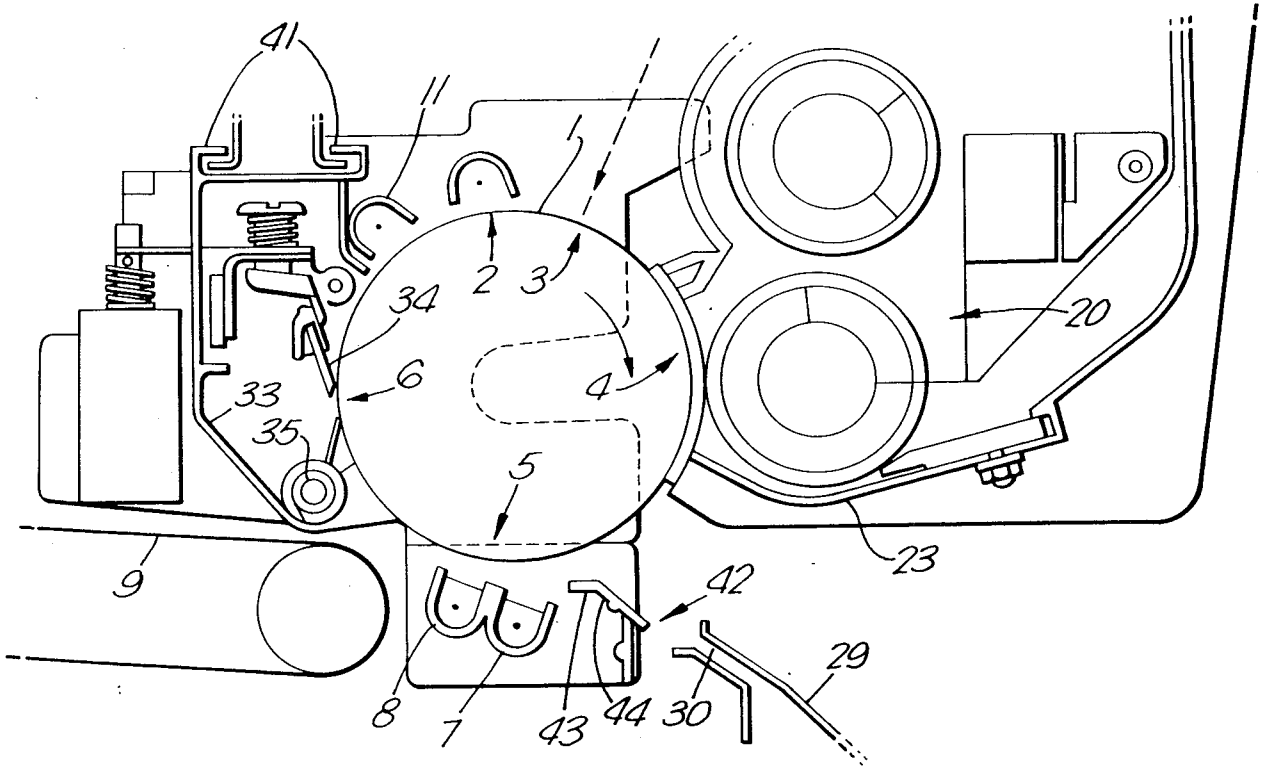
FIG. 2 is an enlarged view of the xerographic drum of FIG. 1 together with its closely associated parts of the machine.

Referring now to FIG. 2, the housing 33 of the cleaning system is a rigid structure to which end plates are secured. The photoreceptor drum 1 is mounted on a shaft which carries its own bearings, the bearings being supported in the end plates by means of spring clips. The ends of the corotrons 2, 7, 8 and 11 are also supported by spring clips on the end plates.

The whole assembly including the cleaning system, photoreceptor and corotrons constitutes a module which is mounted in the machine by means of dowels, two at the front of the machine, and two at the rear, which engage the end plates. A slide arrangement is provided to aid in the removal and replacement of the module, and includes two channels 41 formed as part of the cleaning system housing 33. These channels 41 are on top of the housing 33, the channels being defined by members which stand up from the generally flat top of the housing and then extend towards each other. These inward extensions engage over suitable support rails which extend from the rear to the front of the main machine frame. When the module is fully 'home' in the machine, and located on the dowels, the channels 41 are out of contact with the support rails. A clip arrangement on the machine frame secures the module in place.

The photoreceptor drum 1 consists of an aluminium cylinder which has an oxide barrier layer grown onto the surface by baking it in an oven before a selenium coating is evaporated onto it by vacuum deposition. The photoreceptor is mounted on a shaft by way of end bells. The drum is driven by a gear wheel on the rear end of its shaft, driven by the main machine drive system. The photoreceptor is earthed to the drum shaft by a spring clip in the ends bells.

The corotrons consist of semi-cylindrical aluminium extrusions, with insulating end blocks and corotron wires extending between the end blocks. The charging corotron 2 and the erase corotron 11 are separate units, whereas the transfer corotron 7 and de-tack corotron 8 share a common extrusion having two semi-cylindrical channels in it. The charging corotron 2 has a positive potential applied to the wire which is such as to cause the photoreceptor surface to retain a net positive charge with a potential in the region of 900 volts depending on corotron current and radial spacing of the wire.

As the drum 1 rotates, the charged region of the photoreceptor passes through the imaging station 3 where photons of light from the non-image areas of the original discharge the photoreceptor to about 200 volts (depending on exposure level), thus leaving an electrostatic latent image on the photoreceptor. Potentially superfluous development may be precluded by appropriate flood exposure from a flood exposure system (not shown).

The electrostatic latent image is developed with toner at the developer station 4, and the toner image passes to the transfer station 5 where it is met by a sheet of paper which has been registered at registration position 30 in the paper feeder mechanism to ensure that the image is transferred in correct alignment onto the paper. The transfer corotron 7 applies a charge to the paper which causes it to stick to, and be transported by, the photoreceptor drum. The paper must be presented at the correct angle and position in order to ensure good transfer without smudges or smears, image halo, or mis-registration. The angle and position at which the lead edge of the copy paper hits the photoreceptor drum is achieved by means of the halo baffle 42.

The halo baffle 42 is an aluminium extrusion mounted between the end plates close to the transfer corotron 7, with a generally horizontal field limiting portion 43, extending into the region of the gap between the transfer corotron 7 and the photoreceptor drum 1, to accurately limit the field of the transfer corotron to a predetermined angular extent around the drum, and with a sloping guide portion 44 for guiding copy paper sheets into contact with the drum at the correct location and at the correct angle.

The halo baffle 42 is electrically biased by the biasing arrangement described below with reference to FIGS. 3 and 4, and is electrically isolated from the surrounding parts of the machine so that it can support the potential applied to it. As the copy paper sheet is fed towards the transfer station, it passes over, and in contact with, the sloping guide porton 44 of the halo baffle thereby acquiring a potential substantially the same as that applied to the halo guide. In this way the copy paper sheet is maintained at an appropriate potential, typically around 1500 V, to ensure complete and accurate transfer of the developed latent image from the drum to the copy sheet.

Figure 3:
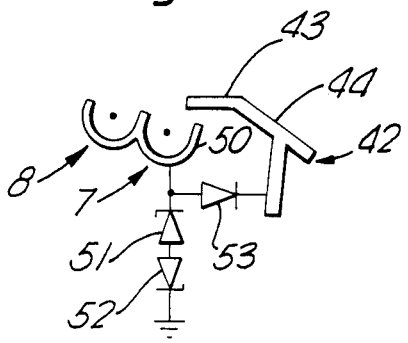
FIGS. 3 and 4 are diagrammatic representations of two alternative embodiments of the transfer means included in the apparatus of the invention.
Figure 5:
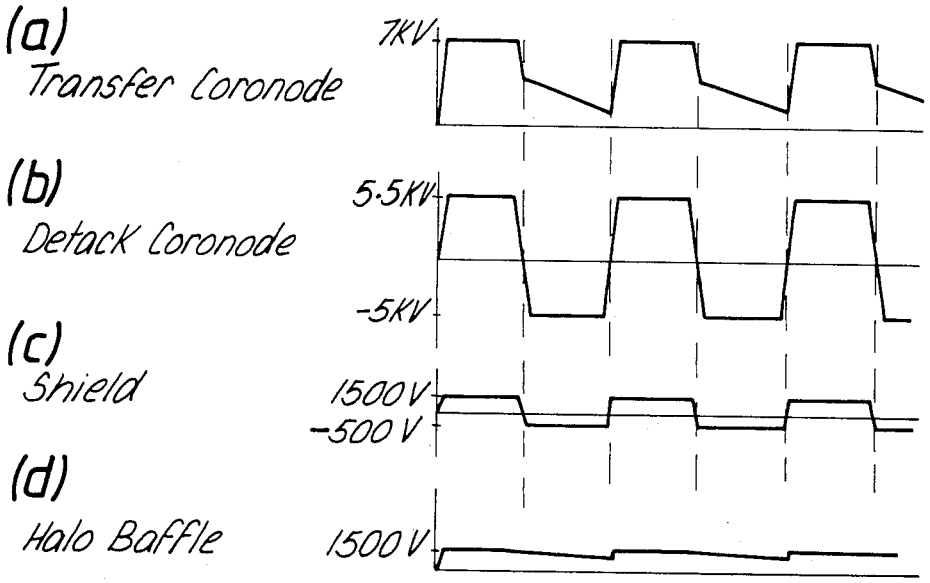
FIGS. 5*a, b, c* and *d* illustrates typical voltage waveforms which occur during operation of the transfer means.

Referring now to FIG. 3, the shield 50 of transfer corotron 7 is allowed to self bias, and this bias is used to bias the halo baffle 42 to the appropriate potential. In the arrangement shown in the drawings, the shield 50 of the transfer corotron 7 is formed as a common structure with the shield of the de-tack corotron 8. The twin shields are accordingly at the same potential at any given time, depending on the potentials applied to the transfer and de-tack corotrons. The de-tack corotron 8 is supplied with a D.C. biased A.C. potential, as indicated in FIG. 5*b* of the drawings, and it is convenient to supply the transfer corotron 7 with a half-wave rectified supply, as shown in FIG. 5*a*. In the arrangement shown in FIG. 3, the shield 50 is grounded via two Zener diodes 51 and 52, having respectively breakdown voltages of around +1500 V and −500 V. This arrangement permits the shield 50 to acquire a bias which fluctuates, as shown in FIG. 5*c*, between about +1500 V and −500 V. An advantage of this arrangement is that the potentials from both corona electrodes to the shield are reduced, thereby reducing the risk of arcing for both corotrons. The positive bias on the shield is limited to +1500 V to avoid early transfer, which could give rise to halo (blurred transferred images), and the negative bias is limited to −500 V to ensure stable operating conditions for the de-tack corotron. By means of a diode 53, only the positive potential is applied to the halo baffle 42, holding the halo baffle at about +1500 V during positive half-cycles of the potentials applied to the de-tack corotron, and allowing a slight diminution due to leakage during negative half-cycles, as indicated in FIG. 5*d*.

Figure 4:
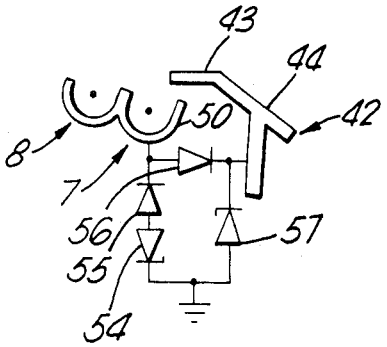

An alternative limiting arrangement is shown in FIG. 4, providing better control of the halo baffle potential. In this arrangement, the shield 50 is grounded through a Zener diode 54 and a diode 55, the Zener diode 54 having a breakdown voltage of −500 V, and the halo baffle 42 is grounded through a Zener diode 55 which has a breakdown voltage of +1500 V. As before, a diode 56 allows only positive voltages to be applied to the halo baffle 42 from the shield 50.

In this way, the halo baffle 42 is maintained at the desired potential without the need for an additional power supply, with the added advantage of a reduced risk of arcing. Furthermore, it is found that biasing the halo baffle provides a sharper cut-off to the corona generated by the transfer corotron, thereby reducing the risk of halo even when the baffle is moved further away from the drum. These factors enable a faster process speed without the attendant risks of corotron arcing or halo.

In a copying machine employing separate transfer and de-tack corotrons, the same principles apply except that there will be no negative potentials applied to the transfer corotron shield. In these circumstances, the shield may be electrically connected directly to the halo baffle, with a Zener diode having a breakdown voltage of +1500 V connected between the shield/baffle and ground.

In conclusion, there has been disclosed herein an improved transfer charge control system. Numerous advantages and applications, in addition to those described above, will be apparent to those skilled in the art. While the embodiments generally disclosed herein are generally considered to be preferred, numerous variations and modifications will be apparent to those skilled in the art. The following claims are intended to cover all such variations and modifications as fall within the true spirit and scope of the invention.

What is claimed is:

1. Electrostatographic apparatus including transfer means for transferring a developed electrostatic latent image from an imaging surface onto a copy sheet, the transfer means comprising:

a transfer corotron, including a shield, operable for transfer of a developed image from the imaging surface to the copy sheet;

a conductive guide member extending into the region between the transfer corotron and the imaging surface, providing a spatial limitation of corona discharge produced by the transfer corotron and guiding copy sheets into contact with the imaging surface;

said shield being self-biasing to a first selected voltage;

said conductive guide member electrically connected to the shield of the transfer corotron, whereby a second selected voltage is provided on said conductive guide member;

means for maintaining said second selected voltage and a selected polarity on said guide member, said second selected voltage and polarity selected to approximate the surface voltage and polarity of a copy sheet during transfer.

2. The apparatus defined in claim 1 wherein said guide member is electrically connected to said shield through a Zener diode whereby only positive portions of the first selected voltage are directed to said guide member.

3. Electrostatographic apparatus including transfer means for transferring a developed electrostatic latent image from an imaging surface onto a copy sheet, the transfer means comprising a transfer corotron including a shield and arranged to be operated at a polarity and potential such as to assist the transfer of a developed image to the copy sheet, and a conductive guide member extending into or adjacent the region between the transfer corotron and the imaging surface to act as a spatial limiter for the corona discharge produced by the transfer corotron and to act as a guide for guiding copy sheets into contact with the imaging surface, the guide member having associated therewith means to maintain thereon a predetermined potential approximating the surface potential of a copy sheet during transfer, and the guide member being in electrical communication with the shield of the transfer corotron, said shield being self-biasing to a potential such as to maintain said predetermined potential on said guide member;

the shield of the transfer corotron is formed integrally with the shield of a de-tack corotron, the de-tack corotron being arranged to be operated by an alternating current potential source; and a first Zener diode through which the shield is grounded for limiting the self-biasing potential of the shield to provide said predetermined potential on the guide member, and a second Zener diode through which the shield is grounded to limit the opposite polarity potential acquired by the shield when said acquired potential is of opposite polarity to said predetermined potential.

4. The apparatus of claim 3 including a diode between the shield and the guide member so that the guide member remains at the polarity of said predetermined potential.

* * * * *